United States Patent [19]

Wedertz et al.

[11] Patent Number: 4,944,226

[45] Date of Patent: Jul. 31, 1990

[54] EXPANDABLE TELESCOPED MISSILE AIRFRAME

[75] Inventors: Larry D. Wedertz, Alta Loma; Jose R. Vazquez, Rancho Cucamonga; Scott R. Schoneman, Ontario, all of Calif.

[73] Assignee: General Dynamics Corp., Pomona Div., Pomona, Calif.

[21] Appl. No.: 234,764

[22] Filed: Aug. 19, 1988

[51] Int. Cl.[5] ..... F42B 13/02

[52] U.S. Cl. ..... 102/476; 102/306; 102/307

[58] Field of Search ..... 102/306, 307, 310, 476.

[56] References Cited

U.S. PATENT DOCUMENTS

| | | | |
|---|---|---|---|
| H58 | 5/1986 | Smith et al. | 102/476 |
| 46,490 | 2/1865 | Orwig | 102/476 |
| 412,670 | 10/1889 | Ross | 89/1 |
| 1,049,144 | 12/1912 | Quisling | 102/35 |
| 2,344,957 | 3/1944 | Anzalone | 162/35 |
| 2,409,904 | 10/1946 | Schermuly et al. | 102/50 |
| 2,426,239 | 8/1947 | Renner | 102/38 |
| 2,507,878 | 5/1950 | Banning, Jr. | 102/51 |
| 2,683,961 | 7/1954 | Britton et al. | 60/35.6 |
| 2,700,337 | 1/1955 | Cumming | 102/49 |
| 2,935,946 | 5/1960 | Gallo et al. | 102/49 |
| 3,256,816 | 6/1966 | Pilcher II | 102/49 |
| 3,347,491 | 10/1967 | Pickart | 244/3.27 |
| 3,698,320 | 10/1972 | Cochran et al. | 102/49.3 |
| 4,823,700 | 4/1989 | Alker et al. | 102/476 |

FOREIGN PATENT DOCUMENTS

| | | | |
|---|---|---|---|
| 2310547 | 1/1977 | France | 102/476 |
| 2455802 | 1/1981 | France | 102/476 |
| 957956 | 5/1964 | United Kingdom | 102/476 |

*Primary Examiner*—Peter A. Nelson

*Attorney, Agent, or Firm*—Henry Bissell; Leo R. Carroll

[57] ABSTRACT

An expandable telescoped airframe for a missile provides a shorter configuration for convenience in handling and a longer configuration to provide added predetermined clearance in front of a shaped charge warhead after launch. The airframe is mechanically locked into its extended configuration upon deployment of its expansion feature by means of a wedge brake collar. Possible deployment means include gas pressure, one or more springs, and a drogue parachute. Tail and other control surfaces spring open after clearing the airframe tube to provide aerodynamic stability.

18 Claims, 2 Drawing Sheets

EXPANDABLE TELESCOPED MISSILE AIRFRAME

BACKGROUND OF THE INVENTION

1. Field of the Invention.

The present invention relates to missile airframes and, more particularly, to means for expanding a missile airframe after launch to provide additional clearance in front of a shaped charge warhead used against armored targets.

2. Description of the Related Art.

The use of shaped explosive charges has become widespread in modern ordnance. Present technology typically utilizes a conical charge in contact with a conical metal liner. When the charge is detonated, the liner is converted by the resulting shockwave into a penetrating jet of metal plasma coincident with the axis of the undetonated charge. Such shaped charges have been utilized in projectiles designed to penetrate heavy armor and fortifications such as bunkers.

In the face of the shaped-charge threat, reactive armor has been developed which incorporates small explosive charges in the armor's outer layer. The function of such small explosive charges is to disrupt the shockwave formed by a shaped charge.

With the advent of reactive armor, tandem warheads have been developed. A tandem warhead utilizes twin shaped charges—a minor charge for triggering the reactive armor and a main charge for penetrating the armor once the reactive function has been disabled.

The efficacy of the shaped charge is highly dependent on the warhead-to-target distance at the time of main charge detonation, as time is required for the jet of metal plasma to fully form. Maximum armor penetration will generally occur when this distance is approximately six times the diameter of the main charge, although a "standoff" distance of about two diameters will still produce a satisfactory result. Since the main charge cannot be detonated until the minor charge has disabled the reactive function of the armor, the standoff distance at the time of main charge detonation cannot be greater than the distance separating the minor and main charges.

At present, the design of missile airframes allows for only a fixed separation between the two charges of a tandem warhead. Such separation is likely to be less than optimum. It would be a great advance in the art of military ordnance to create a missile airframe which could provide the optimum "standoff" distance without sacrificing the ease of storage and handling that accompanies the shorter lengths associated with present designs. A missile airframe which could be transformed after launch from a short initial configuration to a longer configuration with increased standoff would facilitate storage, handling and transport. The increased standoff resulting from the longer configuration would increase target penetration ability.

Some examples of schemes for lengthening projectiles in flight are summarized below.

U.S. Pat. No. 46,490 to Orwig is directed to a projectile with a telescoping stem provided with wings in such a manner that the stem is contracted within the limits of the cartridge bag before firing, but as soon as the projectile leaves the muzzle of the barrel the stem elongates by its own inertia and atmospheric resistance to give balance and steadiness to the projectile in its flight. The stem is secured to a cap which is perforated with holes through which the cartridge bag is filled with powder before attachment to the projectile.

U.S. Pat. No. 1,049,144 to Quisling relates to projectiles which are steered without rotation by means of a rearward extension of the projectile. The steering member is constructed as a sleeve enclosing the projectile and being closed at the rear end by a cap. While in the barrel, the projectile is forced forward in the sleeve by the pressure of the gas generated in the projectile, pressing against the interior of the cap while the latter is forced forward by the driving charge. The gas escapes automatically as soon as its pressure exceeds by a certain amount the pressure from the driving charge acting on the bottom of the cap sleeve, or after the projectile has moved forwardly a certain distance in the sleeve.

U.S. Pat. No. 2,344,957 to Anzalone is directed to a pistol-fired rocket flare equipped with a guiding device comprising a cylindrical sleeve, slidable on the rocket casing, to which four radial vanes are attached at 90 degree intervals along the periphery of the sleeve. After the rocket flare is fired from the pistol, the vanes slide rearward on the casing.

U.S. Pat. No. 2,409,904 to Schermuly et al is directed to a rocket provided with a sliding tail. The rocket comprises a casing, one or more bands slidable on the casing, tail elements secured to said bands and a stop on the casing to limit the rearward movement of the bands along the casing. Means may be provided for locking the tail in position when the bands have engaged the stop.

U.S. Pat. No. 2,426,239 to Renner is directed to a round of ammunition with a telescoping tail structure having a base which is reduced in diameter and provided with external threads while a cup-like cavity extends forward into the body of the projectile a sufficient distance to house an auxiliary propellant charge suitable for propelling a rocket. The auxiliary charge is ignited after the projectile assembly clears the gun muzzle a sufficient distance to extend tube and tail segments. Gas escaping through a fuse tube and rocket tubes exerts an additional propelling influence on the projectile assembly. Blast from the rocket tubes deflected by curved vane surfaces tends to stabilize the assembly by maintaining it in rotation, although the bulk of the stabilizing influence comes from the flow of air through the vanes.

U.S. Pat. No. 2,507,878 to Banning, Jr., is directed to a projectile for ordnance comprising a shot section having its base portion provided with a forwardly, outwardly and rearwardly curved surface facing towards the gases released from the gun in which the projectile is used. The gases released from the muzzle impinge against the curved surfaces of the projectile base and are deflected rearwardly with a consequent increase of muzzle energy of the projectile. A rearwardly extending skirt telescopingly mounted on the projectile has a size to cooperate with the bore of the gun and maintain substantially gastight engagement with the bore after passage of the curved surface past the muzzle and until departure of the skirt from the muzzle. The skirt has a series of gas discharge orifices therethrough substantially in the zone of the periphery of the rearwardly curved surface for discharge of gases during the interval between passage of the peripheral portion of the curved surface beyond the muzzle and the time or flight of the skirt portion from the muzzle.

U.S. Pat. No. 2,700,337 to Cumming is directed to a liquid propellant rocket provided with a movable injector, the movement of which enlarges the combustion chamber and also forces liquid propellant into the combustion chamber. Enlargement of the combustion chamber provides maximum combustion efficiency. Injection of the liquid propellant into the combustion chamber by the movable injector eliminates a separate pressurizing or pumping system.

U.S. Pat. No. 2,935,946 to Gallo et al is directed to a telescoping ram jet construction. A center body portion of the projectile is designed to be telescoped within the combustion chamber when the combustion chamber is not in use. The center body portion houses the fuse, warhead, and fuel tank as well as fuel metering valves and ignition means. Upon firing, the combustion shell is pushed to the rear by aerodynamic forces to expand the projectile to operating position.

U.S. Pat. No. 3,256,816 to Pilcher is directed to an extending boom for sounding rockets and, more particularly, to a device that displaces an instrument away from the main body of a rocket and then holds that instrument at the new position for the remainder of the rocket flight. The extending boom acts as an integral part of the payload structure of the rocket and is of sufficient strength to support the whole forward section of the payload structure in its extended position. The boom is further capable of being stowed in the rocket's nose cone. Air at atmospheric pressure inside the rocket is used to extend the boom.

U.S. Pat. No. 3,347,491 to Pickart is directed to a firearm projectile provided with a device for slowing down or braking. The device comprises at least one member displaceable due to its elasticity or plasticity or its mobility, towards the exterior of the periphery of the projectile or towards the rear of the projectile, or in both these directions to increase the surface of friction in the air. The device may comprise a plurality of small tongue members or an element sliding to the rear under the effect of a spring.

U.S. Pat. No. 3,698,320 to Cochran et al relates to a rocket with a body of cylindrical form and an ogive head over which a sleeve is slidably disposed in nested relation for storage. The sleeve slides rearwardly upon initial movement of the rocket so as to extend from the rear end thereof. The telescoping rear sleeve is used for stabilization of the rocket in flight.

None of the references described briefly above discloses a telescoping missile airframe which extends after launch to increase the separation between tandem shaped charges.

SUMMARY OF THE INVENTION

In brief, arrangements in accordance with the present invention include an extendible telescoping airframe for a missile. In a first configuration, the missile airframe is telescoped into its shortest length for convenience in storage, transportation, and handling. Deployment of the extendible feature of the telescoping airframe after launch of the missile results in a greater overall length of the airframe to provide additional clearance in front of a shaped-charge warhead. The airframe is mechanically locked into its extended configuration upon deployment of its expansion feature by means of a wedge brake collar. Possible means of deployment of the expansion arrangement include use of gas pressure, one or more springs, and a parachute or other drag device. Aerodynamic control surfaces are stowed within the airframe tube until deployment, thus reducing drag and increasing packaging efficiency. Tail and other control surfaces spring open after clearing the airframe tube to provide aerodynamic stability. The aft end of the missile airframe can contain a control section, a drogue, or a base bleed (slow burning propellant) that drops off after launch to reduce the in-flight weight of the missile.

BRIEF DESCRIPTION OF THE DRAWINGS

A better understanding of the present invention may be realized from a consideration of the following detailed description, taken in conjunction with the accompanying drawing in which.

DESCRIPTION OF THE PREFERRED EMBODIMENTS

Figure 1:
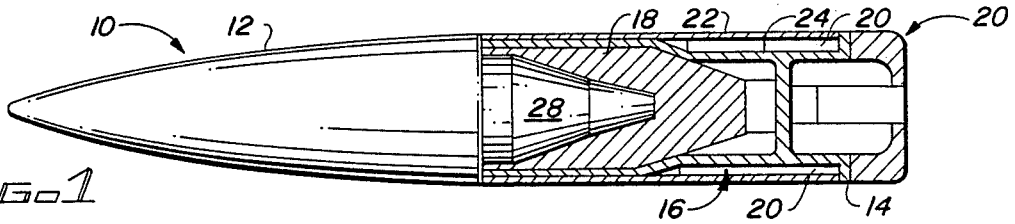
FIG. 1 is a side elevational view, partly in section, of a telescoping missile airframe in accordance with the present invention shown in a compact, telescoped configuration.

An expanding telescoped airframe for a missile in accordance with the present invention is shown in a side elevational view, partly in section, in FIG. 1. The expandable airframe 10 comprises an aerodynamic front portion 12, a rear portion 14, and an extendible telescoping portion 16 contained within front portion 12 in a first, stowed configuration. A shaped-charge warhead 18 is inside telescoping portion 16, as are also three or more flexible tail fins 20. The flexible tail fins 20 are stowed in a circumferential space between an exterior wall 22 of front portion 12 and an exterior wall 24 of telescoping portion 16. An end plate 26 on the end of rear portion 14 is designed to drop off in flight. End plate 26 can contain a control section, a drogue parachute, or a base bleed (slow-burning propellant) that drops off sometime after launch to reduce the weight of the missile. The space 28 inside shaped-charge warhead 18 can be utilized for the placement of various components necessary to the operation of the missile. The telescoped configuration of missile airframe 10 shown in FIG. 1 represents a shortest overall length for the missile with no projecting surfaces. This configuration is convenient for storage, transportation, or handling of the missile.

The type of missile shown in FIG. 1, namely, one that carries a metal-lined, shaped-charge warhead, is usually used against armored targets or fortified installations. The warhead provides penetration through the armor or fortification upon detonation of the charge. The shape of the charge produces shockwaves which are focused along the longitudinal axis of the missile to form a jet of metal plasma which attains a diameter of about one-quarter the original diameter of the warhead. There is an ideal "standoff" distance between the shaped charge and the target at the time the charge is detonated to allow the jet of metal plasma to fully form, thereby providing maximum target penetration. The ideal "standoff" is about six times the diameter of the shaped charge, although effective penetration is still achieved at two diameters.

Figure 2:
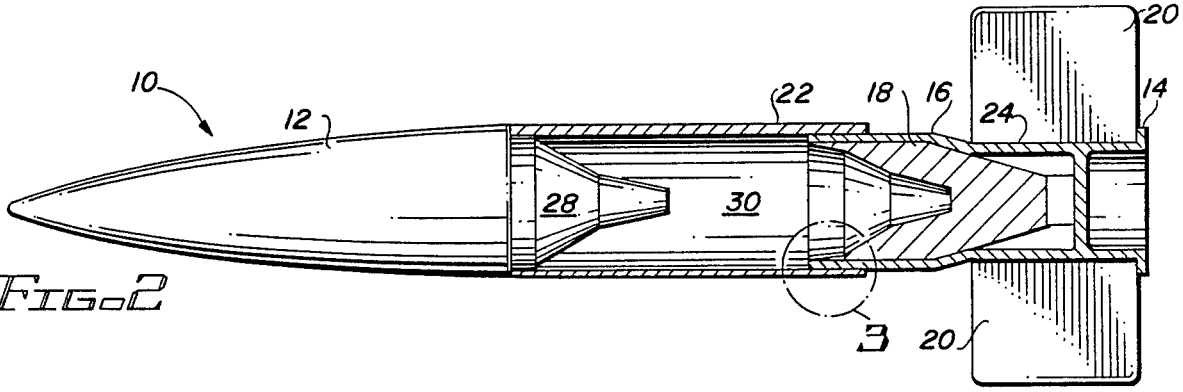
FIG. 2 is a side elevational view, partly in section, of the missile airframe in its extended configuration.

The telescoping airframe 10 of the present invention provides an increased standoff distance for the shaped-charge warhead when the expandable feature of the airframe 10 is deployed, as shown in FIG. 2. Extension of the telescoping portion 16 of the airframe 10 can be accomplished in several ways. For example, the introduction of a pressurized gas 30 into the interior of front portion 12, as shown in FIG. 2, can force the rearward movement of telescoping portion 16 and end portion 14. Flexible tail fins 20 spring open after clearing the airframe wall 22 to stand at right angles to the airframe surface to provide aerodynamic stability to the missile. End plate 26, which has dropped off after deployment of telescoping portion 16, may have contained a base bleed to increase the range of the missile. A base bleed makes use of a slow burning of gas to discourage the formulation of a turbulent wake in back of the missile. After the burning is completed, end plate 26 drops off to decrease the weight of the missile. A wedge brake collar 32 serves to lock telescoping structure 16 in place when it reaches its most rearward position.

Figure 3:
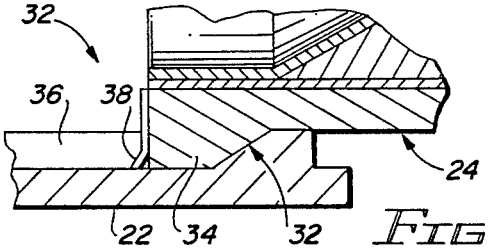
FIG. 3 is a detailed drawing in section of part of the wedge brake collar arrangement as indicated in FIG. 2.

FIG. 3 shows details of the wedge brake collar 32 indicated in FIG. 2. A key 34 at the most forward end of wall 24 of telescoping portion 16 moves in a keyway 36 in wall 22 of front portion 12 which extends the length of the distance which telescoping portion 16 traverses upon deployment. A pressure seal 38 ensures that expanding gas 30 does not escape between walls 22 and 24 as telescoping portion 16 moves rearward with respect to its original, stowed position. A slanted aft surface of key 34 eventually abuts wedge brake collar 32 and jams telescoping portion 16 in place. The arrangement shown in FIG. 3 is repeated at 90 degree intervals around the circumference of the aft section of front portion 12.

Figure 4:
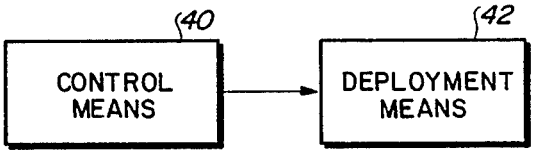
FIG. 4 is a schematic block diagram of a deployment arrangement for the expandable telescoped missile airframe of the present invention.

FIG. 4 is a schematic block diagram of two essential components in the process of deploying telescoping portion 16 in its expanded configuration. Control means 40 actuates deployment means 42 to achieve deployment. For example, control means 40 might be an electrical timer programmed to open a valve to release compressed gas 30 as shown in FIG. 2. In that case, deployment means 42 would consist of a container of compressed gas with an electromechanically actuated valve attached to it. Alternatively, deployment means 42 might comprises a folded drogue parachute stowed in end plate 26 and released electromechanically by control means 40. The drag force on the released drogue would move telescoping portion 26 rearward with respect to front portion 12 until telescoping portion 16 locked in place in its most rearward position.

Figure 5:
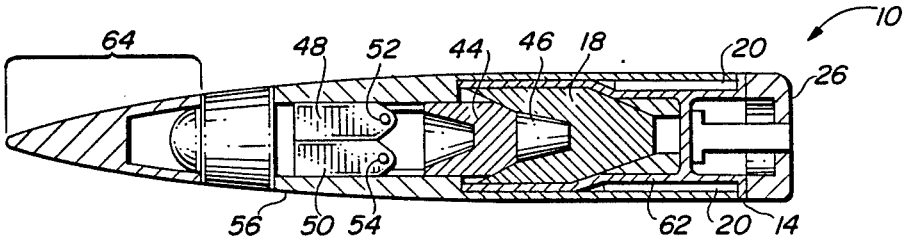
FIG. 5 is a side elevational view in section of a missile airframe in its telescoped configuration with a gas generator used as the means of deployment.

FIG. 5 is a side elevational view, partly in section, of another embodiment of the telescoping missile airframe of the present invention. In this embodiment there is a second warhead 44 nested within shaped charge 18 when telescoping portion 16 is stowed in the most compact configuration of the missile. Occupying the volume between warheads 18 and 44 is a gas generating squib 46 which is ignited electrically to deploy telescoping portion 16 in its expanded configuration. In addition to flexible tail fins 20 stowed circumferentially in the missile airframe, canard wings 48 and 50 are stowed parallel to the longitudinal axis of the missile inside and toward the front. Canard wings 48 and 50 are spring-loaded at rotational hinge positions 52 and 54 so that they are biased to rotate away from the longitudinal axis of the missile when wall portion 56 is cleared by the wings 48 and 50 as a telescoping front portion 58 is extended forward by the gas pressure from burning squib 46.

Figure 6:
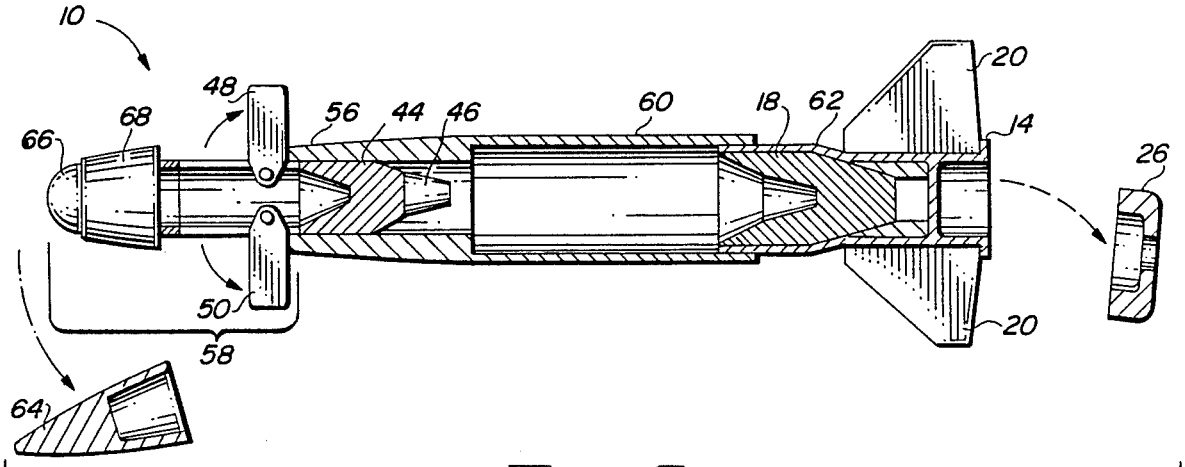
FIG. 6 is a side elevational view, partly in section, of the missile airframe of FIG. 5 in its extended configuration with canard fins and flex tails deployed, with a base bleed being dropped off.

The embodiment of the present invention depicted in its expanded configuration in FIG. 6 comprises a telescoping ogival front portion 58, a middle portion 60, a second telescoping portion 62, and an end portion 14. An aerodynamically shaped nose cone 64 is discarded in flight as the target is approached to allow seeker 66 to view the target. Just aft of seeker 64 is a part 68 of front portion 58 which contains guidance electronics.

The increased standoff distance between second warhead 44 and shaped-charge warhead 18 is partly the result of the forward extension of telescoping front portion 58 and partly the result of the rearward extension of second telescoping portion 62. Flexible tail fins 20 are deployed when second telescoping portion 62 clears the exterior wall of middle portion 60. Base bleed 26 is shown in the process of dropping off in FIG. 6. Wedge brake collar mechanisms can be used in locking telescoping front portion 58 in place and second telescoping portion 62 in place in the extended configuration of missile airframe 10.

Figure 7:
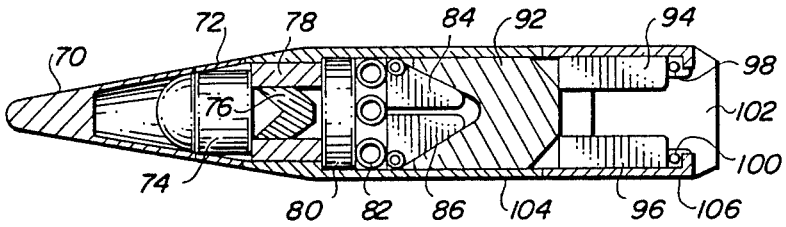
FIG. 7 is a side elevational view in section of a telescoped missile airframe utilizing springs for deployment.
Figure 8:
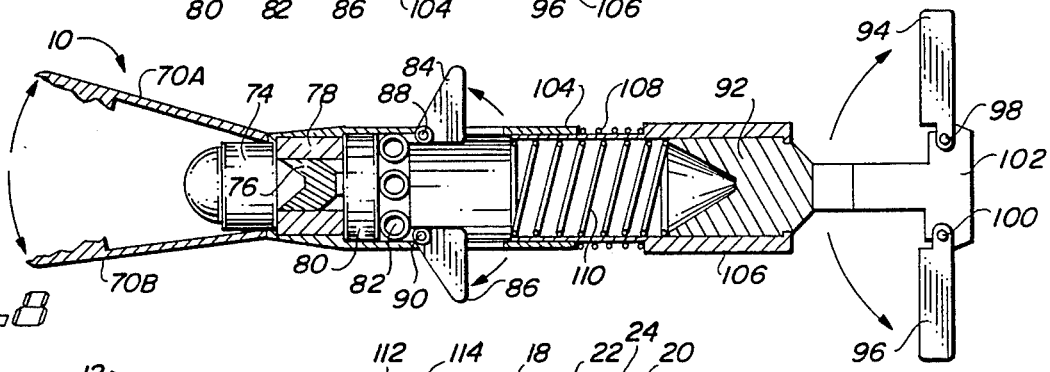
FIG. 8 is a side elevational view in section of the airframe of FIG. 7 after deployment, showing a low-drag nose cone being stripped off in flight.

A third embodiment of the expandable telescoped missile airframe 10 is depicted in FIGS. 7 and 8. A detachable low-drag nose cone 70 covers a forward part of a hemispherical front portion 72. Front portion 72 contains seeker 74, warhead 76, guidance electronics 78, battery 80, and coolant gas bottles 82. Fins 84 and 86 are spring loaded at pivot points 88 and 90 so that they would rotate outwardly from a longitudinal axis of airframe 10 if they were allowed. In a first, compact configuration of the embodiment of expandable telescoped missile airframe 10 shown in FIG. 7, fins 84 and 86 lie folded inside a rearwardly convex cavity of shaped charge 92. Aft of shaped charge 92 lie tail fins 94 and 96, which are hinged at points 98 and 100 and spring loaded to rotate outwardly when released from their stowed position. Control section 102 forms the most rearward part of expandable airframe 10.

A middle portion 104 of the embodiment of expandable missile airframe 10 shown in FIGS. 7 and 8 is telescoped partly into front portion 72 and partly into rear portion 106. As shown in FIG. 8, an expanded configuration of missile airframe 10 is achieved by deployment of springs 108 and 110. Spring 108 pushes rear portion 106 away from middle portion 104. Spring 110 pushes middle portion 104 away from front portion 72 and the contents of middle portion 104 aft through rear portion 106.

Aerodynamically shaped nose cone 70 is divided into pieces 70*a* and 70*b* by the firing of a small explosive squib, and the pieces 70*a* and 70*b* separate from missile airframe 10 in flight. As further shown in FIG. 8, fins 84 and 86 spring outward from missile airframe 10 and tail fins 94 and 96 also spring outward as the expandible feature of airframe 10 is deployed in flight.

Figure 9:
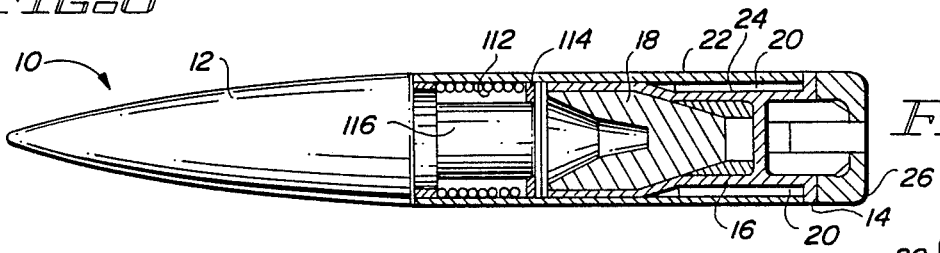
FIG. 9 is a side elevational view, partly in section, of a variation of the missile airframe embodiment shown in FIGS. 1–3.
Figure 10:
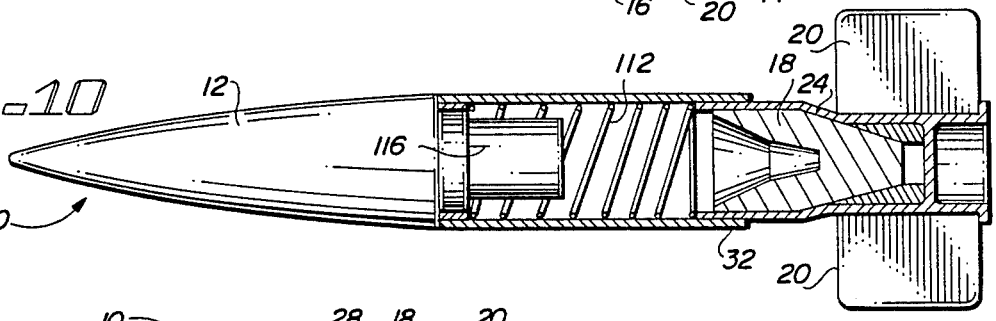
FIG. 10 is a side elevational view, partly in section, or the expanded configuration of the missile airframe of FIG. 9.

FIGS. 9 and 10 depict a variation of the missile airframe embodiment shown in FIGS. 1–3. In FIG. 9 a compressed coil spring 112 inside front portion 12 is constrained from expanding by a plurality of stop tabs 114 extending radially outward from a center structure 116. When it is desired to expand missile airframe 10, stop tabs 114 are withdrawn into center structure 116 to release spring 112. Spring 112 pushes telescoping portion 16 away from front portion 12. As telescoping portion 16 clears exterior wall 22 of front portion 12, flexible tail fins 20 spring outward. End plate 26 has already been discarded in the illustration of FIG. 10.

Figure 11:
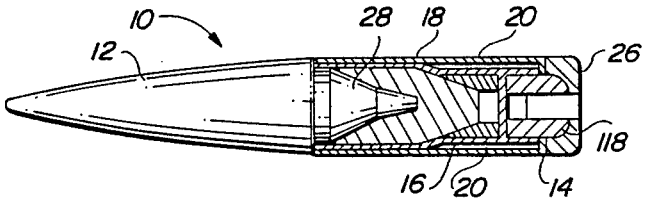
FIG. 11 is a side elevational view, partly in section, of a variation in the embodiment depicted in FIGS. 1–3.
Figure 12:
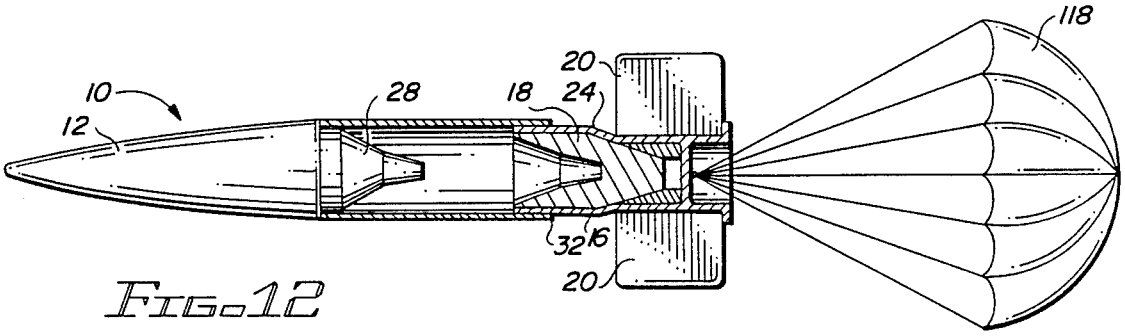
FIG. 12 is a side elevational view, partly in section, of the expanded configuration of the missile airframe in FIG. 11 being deployed.

FIGS. 11 and 12 illustrate another variation in the missile airframe embodiment of FIGS. 1–3. In the variation shown in FIG. 11, a drogue parachute 118 lies folded in an interior space between portion 14 and end plate 26. As shown in FIG. 12, the expandable feature of missile airframe 10 is implemented by releasing end plate 26 in flight to deploy drogue 118. Drogue 118 fills in the wake of airframe 10 and pulls telescoping portion 16 out of front portion 12. After telescoping portion 16 is withdrawn from front portion 12, drogue 118 can be discarded so as not to further slow the missile.

All of the embodiments of expandable telescoped missile airframe 10 and the variations thereof which have been presented result in an increased standoff distance for the shaped charge 18 or 92. The increased standoff distance achieved by the present invention results in greater penetration into a target and increased destructive capability.

Although there have been described above specific arrangements of an expandable telescoped missile airframe in accordance with the invention for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the annexed claims.

What is claimed is:

1. An expandable airframe for a missile carrying a shaped charge comprising:

an aerodynamic front portion;

a rear portion; and an extendible telescoping portion connected between said front and rear portions, contained within said front portion in a first, stowed configuration and extending rearwardly from said front portion in a second, deployed configuration;

wherein an increased distance between a frontmost tip of said front portion and said shaped charge following transition from said first to said second configuration results in more effective penetration by said shaped charge into a target subsequent to detonation of said shaped charge.

2. The missile airframe of claim 1 further comprising deployment means for deploying said telescoping portion in said second configuration.

3. The missile airframe of claim 2 wherein said deployment means comprises an expanding gas.

4. The missile airframe of claim 2 wherein said deployment means comprises a releasable spring under compression which exerts opposing forces on said front and rear portions in said first configuration.

5. The missile airframe of claim 2 wherein said deployment means comprises a drogue parachute stowed in said rear portion in said first configuration and released to effect a change to said second configuration by aerodynamic drag.

6. The missile airframe of claim 2 further comprising locking means for locking said telescoping portion in said second configuration.

7. The missile airframe of claim 6 wherein said locking means comprises a wedge brake collar.

8. The missile airframe of claim 1 further comprising at least three flexible tail fins stored within said front portion when said airframe is in said first configuration and extended transversely from said rear portion when said airframe is in said second configuration.

9. An expandable airframe for a missile carrying a shaped charge comprising:

a telescoping aerodynamic front portion;

a telescoping rear portion; and a middle portion connected to said front and rear portions, within which said front portion is partly stowed and within which said rear portion is partly stowed in a first configuration and from which said front portion extends forwardly and said rear portion extends rearwardly in a second, deployed configuration;

wherein an increased distance between a frontmost tip of said front portion and said shaped charge following transition from said first to said second configuration results in more effective penetration by said shaped charge into a target subsequent to detonation of said shaped charge.

10. The missile airframe of claim 9 further comprising deployment means for deploying said telescoping front and rear portions in said second configuration.

11. The missile airframe of claim 10 further comprising locking means for locking said telescoping portions in said second configuration.

12. The missile airframe of claim 11 wherein said deployment means comprises means for generating gas under pressure inside said airframe to push said front and rear portions away from said middle portion to effect a change to said second configuration.

13. The missile airframe of claim 11 wherein a rearmost part of said rear portion is detachable from said airframe when said deployment means is activated to change said first configuration into said second configuration.

14. The missile airframe of claim 13 wherein said rearmost part of said rear portion comprises a base bleed.

15. The missile airframe of claim 11 further comprising an aerodynamically shaped nose cone which can be separated from said front portion in flight.

16. An expandable airframe for a missile carrying a shaped charge comprising:

an aerodynamic front portion;

a rear portion;

a middle portion at least partly telescoped into said front and rear portions in a first overall configuration; and extension means in the middle portion for extending the aerodynamic front portion relative to the rear portion and locking said front and rear portions in a second overall configuration.

17. The missile airframe of claim 16 wherein said extension means comprises a plurality of springs under compression which are released to push said front and rear portions away from said middle portion.

18. The missile airframe of claim 17 wherein said increased distance is greater than an initial distance by about 2.5 diameters of said shaped charge.

* * * * *